US007509933B2

(12) United States Patent
Dingle

(10) Patent No.: US 7,509,933 B2
(45) Date of Patent: Mar. 31, 2009

(54) VALVE LASH ADJUSTER HAVING ELECTRO-HYDRAULIC LOST-MOTION CAPABILITY

(75) Inventor: Philip J. G. Dingle, Rochester, MI (US)

(73) Assignee: Delphi Technologies, Inc., Troy, MI (US)

( * ) Notice: Subject to any disclaimer, the term of this patent is extended or adjusted under 35 U.S.C. 154(b) by 326 days.

(21) Appl. No.: 11/368,739

(22) Filed: Mar. 6, 2006

(65) Prior Publication Data

US 2007/0204818 A1 Sep. 6, 2007

(51) Int. Cl.
*F01L 1/14* (2006.01)

(52) U.S. Cl. ..... 123/90.52; 123/90.39; 123/90.43; 74/569

(58) Field of Classification Search ..... 123/90.39, 123/90.44, 90.45, 90.46, 90.48, 90.52, 90.55, 123/90.43; 74/559, 567, 569
See application file for complete search history.

(56) References Cited

U.S. PATENT DOCUMENTS 5,680,841 A * 10/1997 Hu ..... 123/322
6,039,017 A 3/2000 Hendriksma
6,591,795 B2 * 7/2003 Janak ..... 123/90.12
6,827,067 B1 * 12/2004 Yang et al. ..... 123/568.14
6,883,492 B2 4/2005 Vanderpoel et al.
6,920,868 B2 * 7/2005 Ruggiero et al. ..... 123/568.14

* cited by examiner

*Primary Examiner*—Ching Chang
(74) *Attorney, Agent, or Firm*—Thomas W. Two

(57) ABSTRACT

In a Type 2 engine, a valve deactivation hydraulic lash adjuster (DHLA) in accordance with the invention replaces a conventional hydraulic lash adjuster in the train of a gas-exchange valve in a compression-ignited engine. In a Type 3 engine, a similar DHLA is disposed within an articulated rocker arm which is made selectively competent (valve activating) or incompetent (valve deactivating) thereby. A solenoid valve within the assembly diverts hydraulic fluid between support and non-support of a piston slidably disposed in a housing and terminating in a ball head. The valve is force-balanced. The preferred hydraulic fluid is diesel fuel, allowing for smaller diameter passages and cleaner operation than in prior art systems, eliminating the need for an accumulator chamber and accumulator piston as in the prior art. An alternate version of a type 3 engine having a DHLA, in accordance with the invention, is also shown.

11 Claims, 10 Drawing Sheets

VALVE LASH ADJUSTER HAVING ELECTRO-HYDRAULIC LOST-MOTION CAPABILITY

TECHNICAL FIELD

The present invention relates to variable valve activation (VVA) and variable valve timing (VVT) mechanism for internal combustion engines; more particularly, to VVA/VVT mechanism for modulating the timing of compression ignited (CI) engines such as diesel engines; and most particularly, to a valve lash adjuster having electro-hydraulic lost-motion capability for varying the lift and/or timing of individual valves in a valve train of a multi-cylinder engine.

BACKGROUND OF THE INVENTION

Means for varying the timing of valve actuation of internal combustion engines are well known. Such means typically take the form of a camshaft phaser or an element of a valve train, such as rocker arms, roller finger followers, hydraulic valve lifters, or hydraulic lash adjusters, provided with a mechanism for switching between a valve activating mode and a valve deactivating mode. VVA/VVT is especially well known in spark-ignited (SI) engines, in which it is an essential element of various schemes for improving fuel economy. However, camshaft phasers, while readily applied to SI engines, are not as suitable for CI engines since cam phasing introduces the risk of catastrophic valve-to-piston collisions due to the close proximity of the piston crown to the cylinder head at top dead center (TDC) at which point the valves are obliged to be closed. For this reason, an alternative technology, known in the art as "lost motion", has found increasing favor for VVT/VVA in CI engines, since much of the functionality of existing SI VVT/VVA systems is available without danger of piston/valve collisions.

The potential importance of VVT/VVA to CI engine performance is coming to be realized within the engine industry. The firing of an SI engine is readily and accurately controlled by simply controlling the timing of the ignition spark. The firing of a CI engine, and more particularly so the firing of a controlled auto-ignition (CAI) or homogeneous charge compression ignition (HCCI) engine on the other hand, is governed by a plurality of independent or loosely-dependent variables which conspire to cause the fuel/air charge to explode at some resultant combination of temperature, pressure, and mixture.

These variables, which include, but may not be limited to, cylinder temperature, cylinder pressure, valve train timing and wear, fuel injection timing and accuracy, homogeneity of the fuel/air charge, and thermal load of the fuel/air charge, can vary from cylinder to cylinder in an individual engine and furthermore can vary for any given cylinder from one firing cycle to the next. Thus, in the prior art the exact point in the compression stroke at which the compressed charge in a cylinder will ignite cannot easily be predicted or controlled to a very high degree of certainty, and in practice the cylinders of a multiple-cylinder HCCI engine may not fire with a degree of uniformity required to meet future performance standards.

In a CI engine, the trapped air mass is the "charge volume" in the cylinder upon which compression work is done. Because adiabatic compression of the charge volume is the mechanism by which CI ignition is induced, an important ignition factor is the "Effective Compression Ratio" (ECR) within the cylinder. Thus, direct control of ECR can provide improved control of firing timing both in individual cylinders and among the cylinders in a CI engine. Controlling ECR by increasing the compression ratio can improve cold start characteristics, and by decreasing the compression ratio can improve engine performance. Other engine control strategies that can be attained by strategically controlling the opening, closing and lift of the gas valves in a CI engine, as more fully described in co-pending U.S. patent application Ser. No. 11/027,109, include in-cylinder swirl of intake gases to provide effective mixing of injected fuel and air, and controlled Exhaust Gas Recirculation (EGR) to control combustion initiation and burn rates, while lowering flame temperatures for reduced $NO_x$ emissions.

In a Type 2 engine valve train, a roller finger follower (RFF) typically is interposed between an inwardly-opening poppet valve stem tip at one end and a hydraulic lash adjuster (HLA) at the distal end, with a cam lobe providing motivation to the RFF at an intermediate point. For reasons of good dynamic performance at high speed, low friction, and convenient packaging, this mechanism is rapidly becoming the valve train of choice for many new light-duty engines today, both SI and CI.

In a Type 3, 4, or 5 valve train, a rocker arm pivots on a rocker shaft, with one end of the rocker arm being motivated by the camshaft either directly or through the medium of a follower and/or pushrod, and the other end actuating the engine valve. For reasons of valve train cost, packaging convenience, or tradition, these systems are frequently used for medium- to heavy-duty engines and may or may not use an HLA. (For simplicity of presentation hereinbelow, Type 3 should be understood to mean all central-pivot rocker arm engines, including Types 4 and 5.)

In another version of the Type 3 valve train, the rocker arm pivots on an inverted HLA instead of a rocker shaft. Since the HLA is stationary, this type of valve train offers reduced dynamic mass advantages over other Type 3 valve train.

Lost motion means in a valve train element switches the linear motion imparted to the valve train by a rotating cam between either of a valve stem/lifter/pushrod or rocker arm and a lost motion spring/piston/accumulator. In the valve activating mode, the switchable element is mechanically and hydraulically competent to transfer the motion instructions of the cam to the valve; but in the valve deactivating mode, the switchable element collapses by a controlled amount and at the appropriate time in some fashion to "lose" the motion of the cam and belay those instructions to the valve. See, for example, U.S. Pat. No. 6,883,492.

Serious drawbacks of such known VVA/VVT systems are that they employ engine lubricating oil as the hydraulic medium, which tends to be dirty, carbon-laden and relatively high viscosity, requiring relatively large passageways to prevent flow failure; they employ a relatively bulky, powerful solenoid control valve which because of its size has a relatively slow speed of response; and they introduce significant additional complexity to the cylinder head that, in so doing, creates problematic packaging and manufacturing issues.

It is highly desirable that any apparatus and control system for improved control of ECR be applicable to existing arrangements of Type 2 and Type 3 engine valve trains with a minimum of engine redesign.

What is needed in the art is an improved means for controlling engine strategies such as, for example, ECR, EGR and in-cylinder swirl in a CI engine.

What is further needed is that such improved means be applicable to, and controllable for, individual cylinders in a multiple cylinder engine.

It is a principal object of the present invention to improve control of various engine control strategies in a CI engine.

It is a further object of the invention to provide such improved control with minimum redesign requirements for Type 2 and Type 3 engines.

It is a still further object of the invention to provide such improved control through novel adaptation of existing fuel injection equipment (FIE) technologies which have been demonstrated to have the speed of response, precision, and durability required for an ECR control system.

SUMMARY OF THE INVENTION

Briefly described, in a Type 2 engine, a valve deactivation hydraulic lash adjuster (DHLA) in accordance with the invention replaces a conventional hydraulic lash adjuster in the train of a gas-exchange valve in an internal combustion engine, and especially a compression-ignited engine. In a Type 3 engine, a DHLA is disposed within an articulated rocker arm which is made selectively competent (valve activating) or incompetent (valve deactivating) thereby. In the version of the Type 3 engine described above, a DHLA is disposed above the rocker arm at a center pivot point and replaces a conventional hydraulic lash adjuster.

In each approach, an electrically controlled solenoid valve within the DHLA assembly diverts hydraulic fluid between support and non-support of a piston slidably disposed in an elongated housing and terminating in a ball head. The geometry for the valve is such that the valve pin is force-balanced, thus reducing significantly the required strength and size of solenoid relative to the prior art solenoid and valving.

The preferred hydraulic fluid is diesel fuel which is readily available in a diesel engine from the low-pressure fuel supply pump for the engine fuel rail, which fuel preferably is used to lubricate the entire "top end" of the engine. Relatively dirty, carbon-contaminated engine lubricating oil is relegated to lubricating only the engine crankshaft and cylinder bores. The continuously refreshed and very much cleaner diesel fuel is used to lubricate the camshaft bearings and valve train, with conventional seals providing segregation of the two fluids. It is understood that the lubricity of diesel fuel is less than that of lubricating oil, however there is a clearly defined minimum standard for lubricity against which the bearing surfaces may be designed. Use of diesel fuel rather than engine lubricating oil allows for substantially smaller diameter passages and cleaner operation than in prior art systems. The use of smaller passages reduces very significantly the amount of fluid to be diverted between operating modes, eliminating the need for an accumulator chamber and accumulator piston as in the prior art.

BRIEF DESCRIPTION OF THE DRAWINGS

The present invention will now be described, by way of example, with reference to the accompanying drawings, in which.

DESCRIPTION OF THE PREFERRED EMBODIMENTS

The benefits and advantages of a valve deactivating electro-hydraulic lash adjuster in accordance with the invention may be better appreciated by first considering a prior art variable valve deactivation system.

Figure 1:
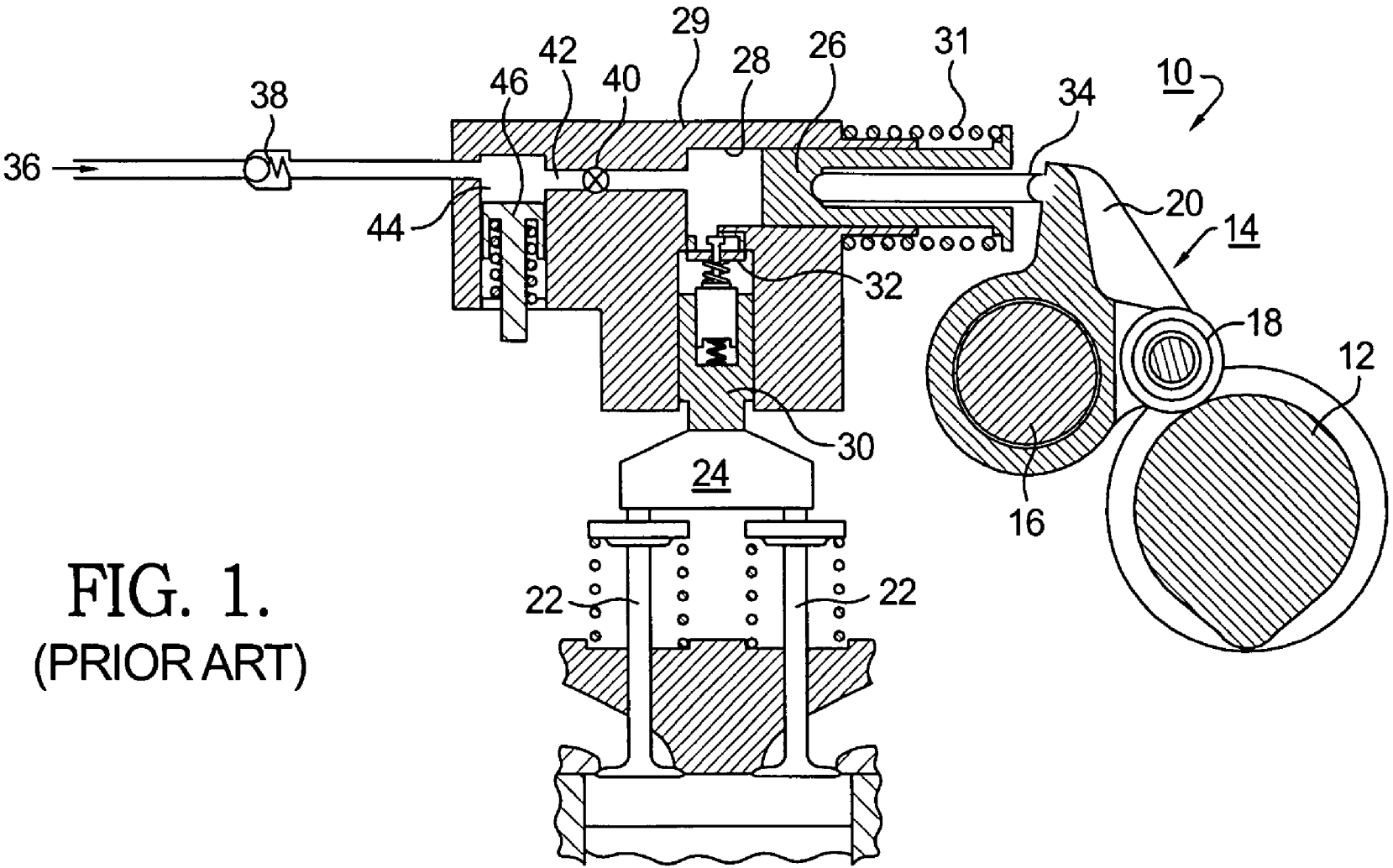
FIG. 1. (PRIOR ART)
FIG. 1 is an elevational cross-sectional view of a prior art valve deactivation system substantially as disclosed in U.S. Pat. No. 6,883,492.
Figure 7:
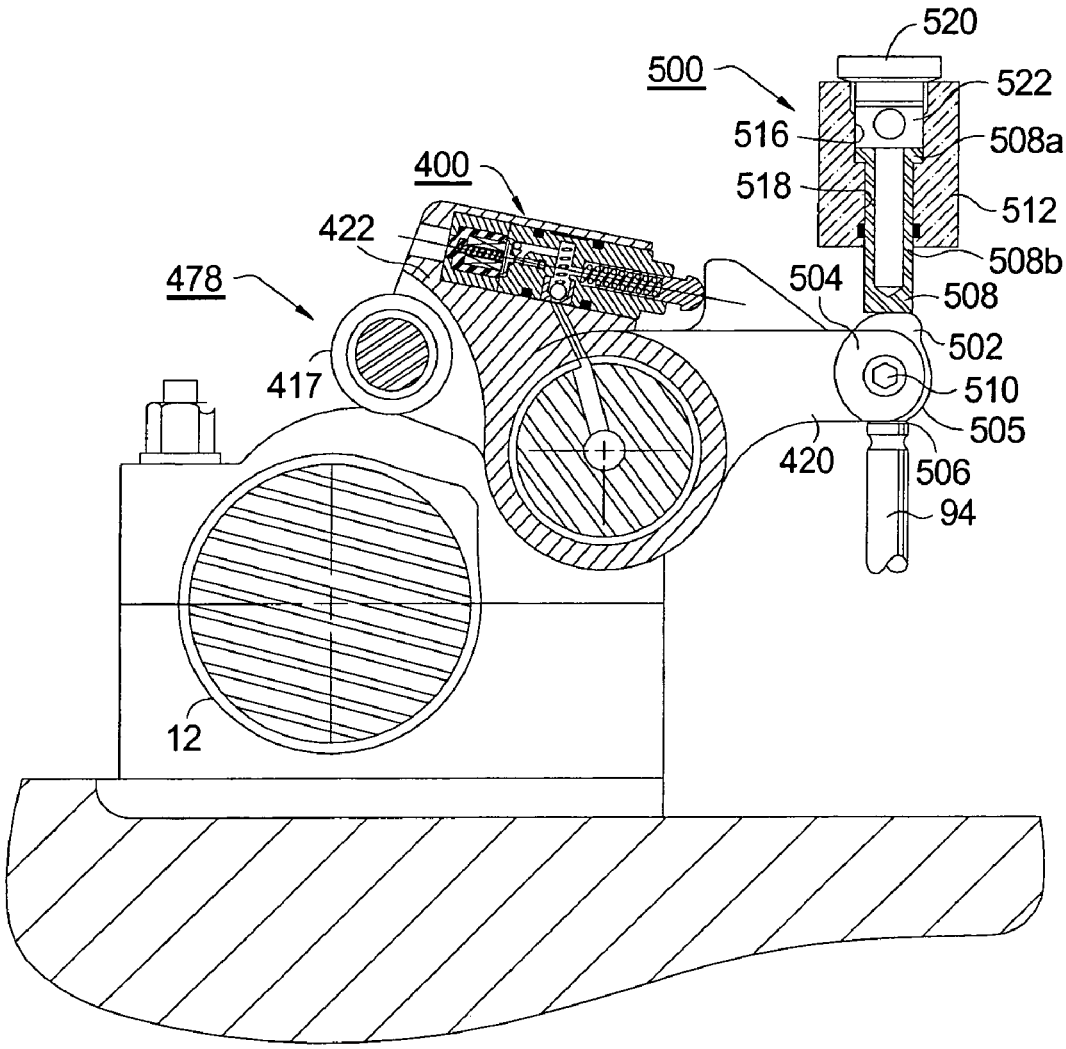
FIG. 7 is a view like that shown in FIG. 6, showing the VDRA in valve-deactivation lost-motion mode.

Referring to FIG. 1, a prior art variable valve activation/deactivation lost-motion system 10 is substantially as disclosed in FIG. 7 of U.S. Pat. No. 6,883,492. The valve train includes an engine cam shaft 12; a rocker arm 14 rotational upon a rocker shaft 16 and comprising a cam roller follower 18 and an actuation arm 20; first and second paired engine valves 22 jointly operated by a valve bridge 24; a master piston 26 disposed in a main bore 28 in engine head 29 and biased by a return spring 31; and a slave piston 30 disposed in a slave bore 32 in communication with the main bore. The master piston is energized by a push tube 34 connected to actuation arm 20. Hydraulic fluid 36 in the form of engine oil from the engine crankcase is supplied to the main and slave bores via a check valve 38 and a solenoid-operated trigger valve 40 disposed in a feed passage 42. A lost-motion accumulator chamber 44 in communication with main bore 28 includes an accumulator piston 46.

In operation, rotation of camshaft 12 causes oscillation of rocker arm 14 which drives master piston 26 within main bore 28. If trigger valve 40 is closed (valve-enabling mode), slave piston 30 is displaced by the motion of master piston 26, displacing bridge 24 and actuating valves 22. If trigger valve 40 is open (valve-disabling mode), the valve springs keep valves 22 closed, and accumulator piston 46 is displaced in lost motion within accumulator chamber 44 by the motion of master piston 26.

As noted above, known VVA/VVT systems such as prior art system 10 have several serious drawbacks, which the present invention overcomes. First, they employ engine lubricating oil as the hydraulic medium, which tends to be dirty and relatively high viscosity, requiring relatively large passageways to prevent flow failure. Furthermore, the dirty fluid encourages the use of relatively low hydraulic pressures to minimize abrasive wear, which in turn requires large diameter pistons. To minimize parasitic loss of hydraulic fluid, an accumulator piston device is necessary to store and recuperate the displaced fluid. Second, they employ a relatively bulky, powerful solenoid and non-force-balanced control valve which because of their size have a relatively slow speed of response; further, they occupy an undesirably large region within and adjacent to the cylinder head. Third, they introduce significant additional complexity to the cylinder head that requires extensive and expensive redesign and modification of engine manufacturing lines.

Figure 2:
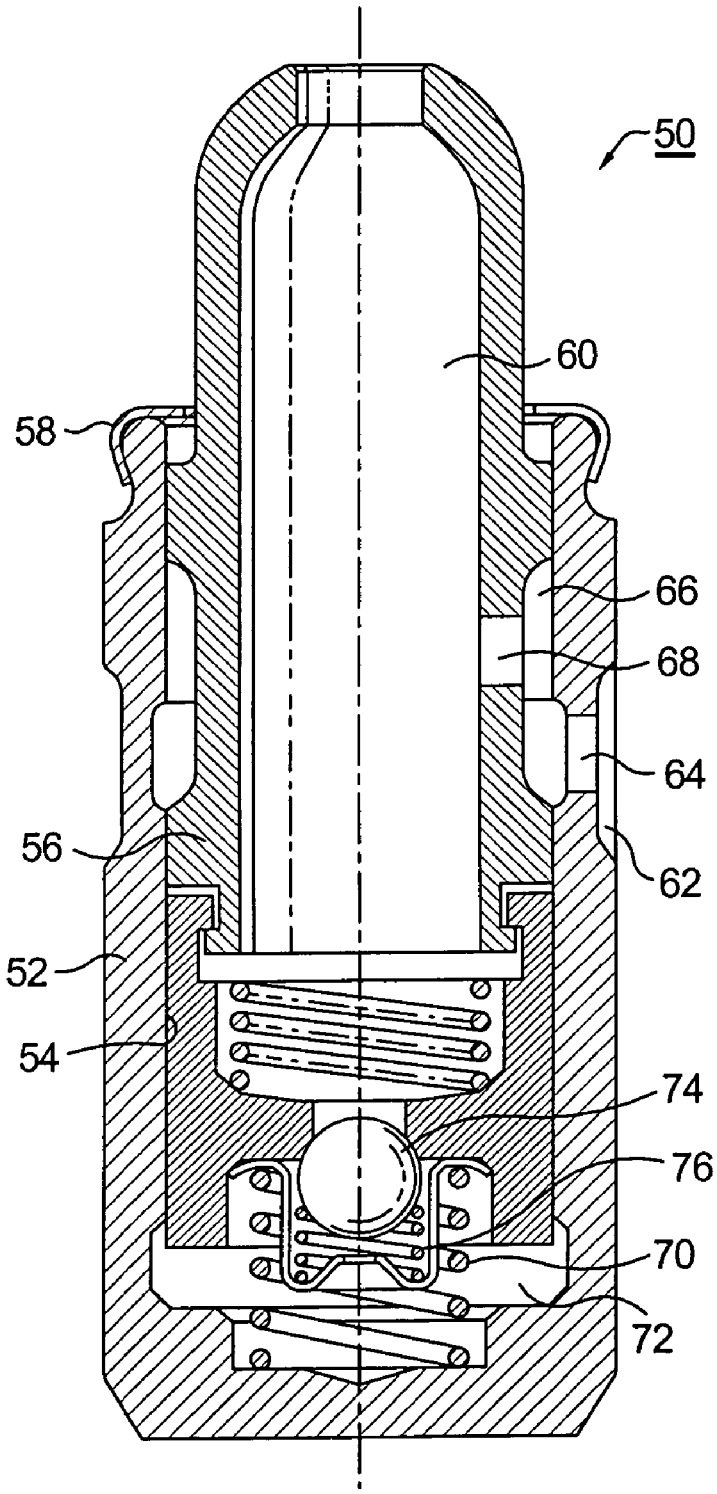
FIG. 2. (PRIOR ART)
FIG. 2 is an elevational cross-sectional view of a typical prior art hydraulic lash adjuster.

Referring to FIG. 2, a typical prior art hydraulic lash adjuster 50, substantially as disclosed in U.S. Pat. No. 6,039,017, comprises a cylindrical adjuster body 52 having a bore 54 for slidably receiving a domed hollow plunger 56 retained in bore 54 by a retainer 58. A low pressure reservoir 60 within plunger 56 receives oil from an engine gallery (not shown) in communication with a first annular distribution groove 62 formed in body 52, a first supply port 64 through body 52 to a second annular distribution groove 66 formed in plunger 56, and a second supply port 68 through plunger 56 to reservoir 60. A lash-adjusting spring 70 disposed between body 52 and plunger 56 urges plunger 56 outwards of bore 54 to remove lash in the associated valve train (not shown). As plunger 56 moves outwards of bore 54, a vacuum is created in high-pressure chamber 72, drawing oil into chamber 72 from reservoir 60 via check valve 74 by compressing check valve spring 76.

The objective of an HLA such as HLA 50 is to eliminate the lash that is an essential feature of traditional mechanical valve train linkages. This lash, or clearance, changes due to engine temperature, initial setting errors, and valve train wear. The lash adjuster compensates for these effects through a limited range of automatic adjustment, typically up to 5.0 mm maximum, so that intended engine operation is continuously maintained.

Figure 2A:
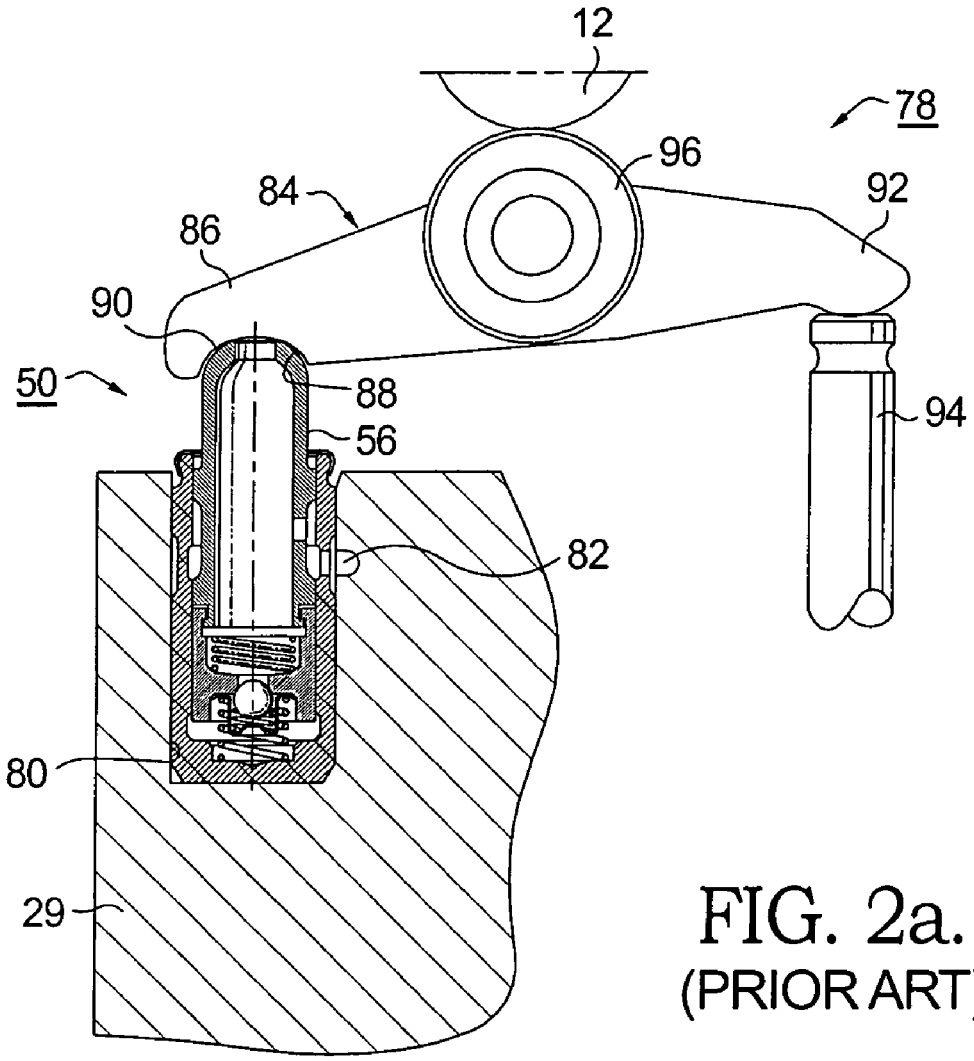
FIG. 2a. (PRIOR ART)
FIG. 2*a* is an elevational cross-sectional view of a prior art Type 2 valve train employing the hydraulic lash adjuster shown in FIG. 2.

Referring to FIG. 2*a,* in a prior art Type 2 valve train 78, HLA 50 is disposed in a well 80 formed in engine head 29. Oil is supplied via an engine oil gallery 82. A roller finger follower (RFF) 84 comprises a first arm 86 having a hemispherical seat 88 for receiving head 90 of plunger 56 and a second arm 92 for engaging and actuating valve stem 94. A roller 96 disposed between first and second arms 86, 92 follows camshaft 12, the eccentric motion of which is translated into axial reciprocal motion of valve stem 94 because HLA 50 is incompressible.

Selective disabling of the motion of valve stem 94, to selectively deactivate the associated engine valve in accordance with the invention, may be achieved by providing an improved hydraulic lash adjuster means that is selectively compressible in lost motion in lieu of motion of valve stem 94. Provision of such lost-motion to the valve train requires a larger range of controlled adjustment than is required for HLA 50, and this must be equal to or greater than that of either the cam lift or the full valve lift, depending upon the system geometry. Thus a lost-motion valve train mechanism must incorporate this extended range of collapsible travel to negate the cam lift; must provide additionally the adjustment range of a lash adjuster; and also must provide a control mechanism having a speed of response high enough to provide resolution of valve event control to within ±5 crank degrees of a target value. Moreover, this functionality must be packaged in a manner that makes it compatible with the constraints of modern engines, which implies that it should be dimensioned substantially similar to existing valve train components. Thus replacing a conventional HLA for selective valve deactivation is an excellent and novel strategy that can meet these criteria.

Figure 3:
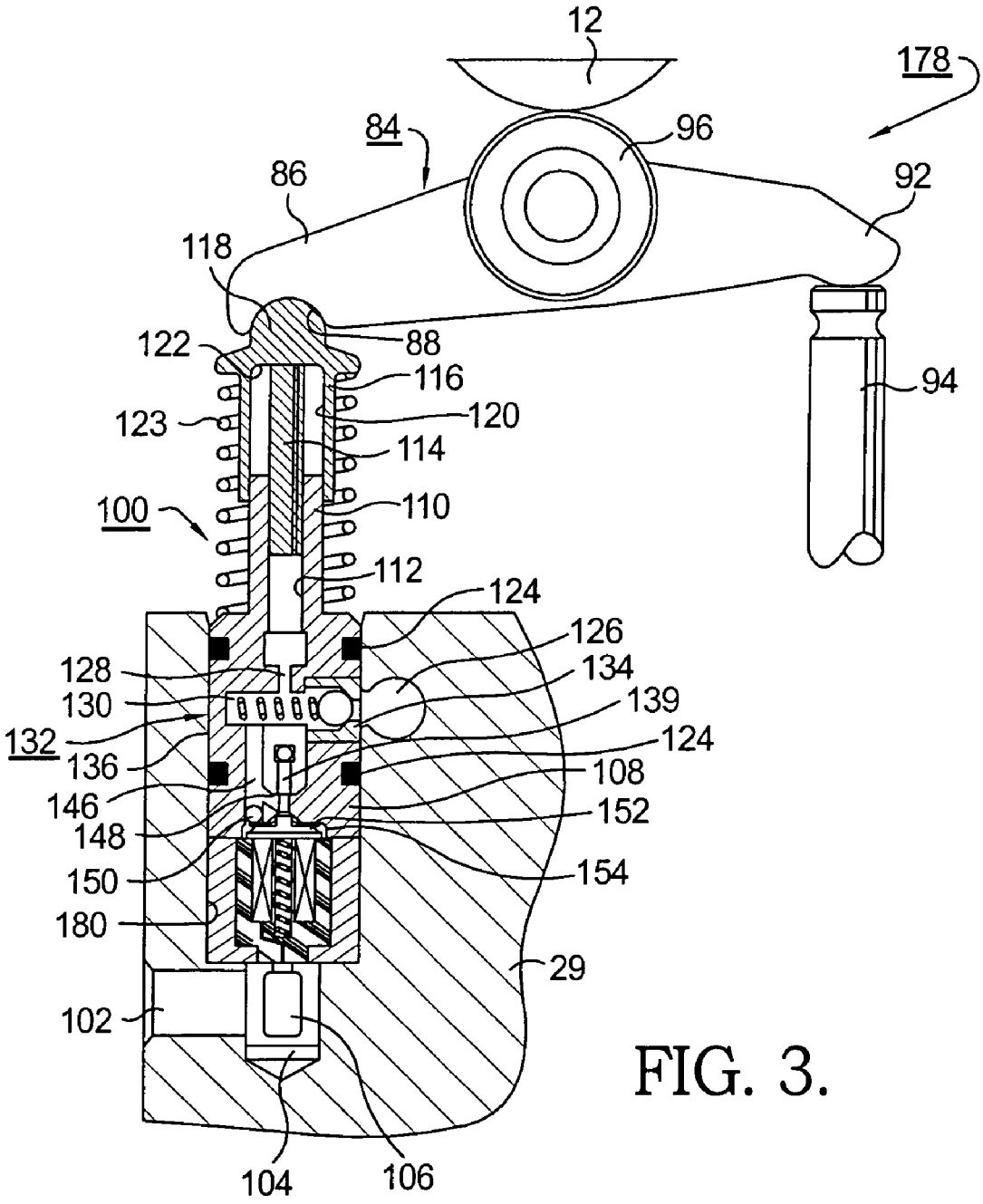
FIG. 3 is an elevational cross-sectional view of a Type 2 valve train employing a first embodiment of a Type 2 valve deactivation hydraulic lash adjuster in accordance with the invention.
Figure 4:
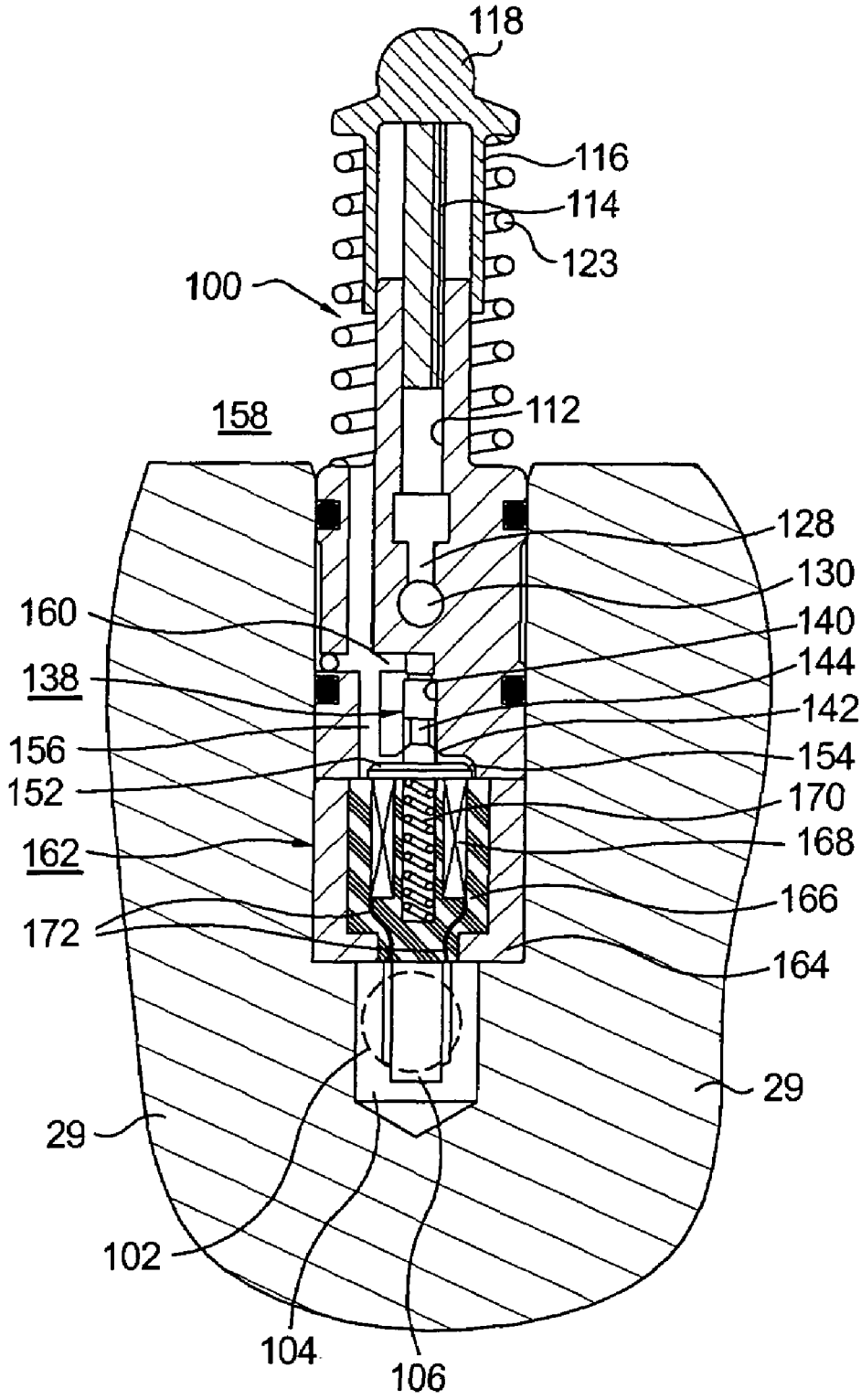
FIG. 4 is an elevational cross-sectional view of the DHLA shown in FIG. 3, taken orthogonal to the view therein.

Referring to FIGS. 3 and 4, in a Type 2 deactivation valve train 178 in accordance with the invention, a first embodiment 100 of a deactivation hydraulic lash adjuster (DHLA) is disposed in a well 180 in head 29 similar to prior art well 80 except that well 180 is somewhat deeper to accommodate the necessary added length of DHLA 100 and a cross bore 102 at the distal end 104 accommodates an electrical connector (not shown) for spade lug 106.

A steel body 108 close-fitting into well 180 includes a snout 110 having a bore 112 at its outer end into which a close-fitting piston 114 is slidably disposed. A requirement for minimal fluid leakage between piston and bore suggests that these items are preferably match-ground during manufacture as is common practice in manufacture of fuel injectors. A sleeve 116 having a spherical end 118 and a well 120 is slidably disposed on snout 110. Spherical end 118 engages with hemispherical seat 88, and piston 114 has an exposed length sufficient to accommodate both valve lost-motion travel and lash adjustment travel. Piston 114 is preferably not attached to sleeve 116 but rather engages sleeve 116 via a pressure plate 122 defined by the bottom of well 120 over which piston 114 is free to wander. Thus, side loads applied to DHLA 100 from RFF 84 are carried by sleeve 116 and snout 110, leaving piston 114 free to reciprocate within bore 112 without bending loads being imposed upon it. An external bias spring 123 is disposed around sleeve 116 between body 108 and head 118 to urge DHLA 100 into continuous contact with RFF 84.

Body 108 is preferably sealed into well 180 by first and second O-rings 124 disposed on either side of a hydraulic fluid gallery 126 formed in head 29 for supplying hydraulic fluid to DHLA 100. As discussed hereinabove, a preferred hydraulic fluid in accordance with the invention is diesel fuel which may be conveniently supplied to gallery 126 parasitically from a low-pressure pump (not shown) in an existing engine system for supplying diesel fuel to a fuel injector rail (not shown). The low-pressure stage in a typical diesel engine fuel supply system operates at about 6 bar, which pressure is quite suitable for operation of DHLA 100.

Within body 108 and communicating with bore 112 via first and second drillings 128, 130 is a spring-loaded inlet check or non-return valve 132 which may be of the ball or flute-guided conical seat type. Preferably, valve seat 134 is pressed into place to retain the valve components, although alternative constructions and orientations are fully contemplated by the invention, including but not limited to a reversed valve wherein the seat is machined directly into the body and a blanking plug is used to retain the spring; and a valve bore drilled at an angle which may allow packaging in a smaller diameter body. A shallow annular groove 136 permits access of hydraulic fluid from gallery 126 to check valve 132 at any installed rotational orientation of DHLA 100.

Further within body 108 is a lost-motion control valve 138 disposed in an axial bore 140 having a valve seat 142. Valve 138 which is spring-biased closed, is of a two-way two-position "balanced" spool design wherein opening and closing hydraulic forces are substantially equal at all times. A reduced-diameter central portion 144 of valve pin 139 is in communication with check valve 132 via third and fourth drillings 146, 148, drilling 146 being blanked by a plug 150. Hydraulic pressure created within body 108 acts upon control valve 138, but since the upper piston portion of the valve is substantially the same diameter as the diameter of seat 142, there is no resultant axial force due to pressure on the control valve; thus a low-force actuator is adequate to provide rapid valve motion.

An armature 152 disposed in an armature cavity 154 formed in body 108 is connected to valve pin 138. In opening, valve 138 is withdrawn off of seat 142 into cavity 154. Hydraulic fluid flows across seat 142 into armature cavity 154 and into a drilling 156 that breaks out into the under valve cover area 158 of the engine. Preferably, a cross drilling 160 breaks into bore 140 above valve 138 so that both ends of the valve are pressure balanced and in communication with area 158 pressure.

Within well 180 in head 29, a solenoid stator assembly 162 is disposed adjacent body 108. Assembly 162 includes a steel shell 164 providing a load path for the valve train forces into cylinder head 29. Shell 164 receives a molded-in stator 166, solenoid windings 168, and a valve return spring 170 surrounding armature 152. Electrical leads 172 extend to spade lug 106. Preferably, stator assembly 162 is assembled and tested prior to attachment to adjuster body 108 as by electron-beam or laser welding.

In normal operation, diesel fuel oil is supplied to the gallery 126 in the cylinder head 29 that feeds the deactivation hydraulic lash adjuster 100 (and all other such lash adjusters in a bank of engine cylinders). At a nominal feed pressure of 6 bar, this fuel is readily able to overcome the light spring load of check valve 132 and therefore to fill the interior drillings 128, 130, 146, 148 and thereby assist bias spring 123 in loading RFF 84 against camshaft 12. With lost-motion piston 114 extended so that the RFF is in contact with the cam on its base circle portion, all mechanical lash in the valve train is taken up, and check valve 132 then seats under coercion of its own spring. As camshaft 12 rotates in operation of the engine, an axial compressive load is applied to piston 114 that is in proportion to the dynamic load from the engine valve and spring. This load is reacted by hydraulic fluid captive within DHLA 100 and therefore, except for any undesired leakage past piston 114, check valve 132, and control valve 138, the piston and therefore the fulcrum for RFF 84 remains stable. By keeping internal fluid volume to a minimum, piston depression due to fluid compressibility is very low. In this situation, no activation of control valve 138 occurs and engine valve motion is determined by the cam profile.

If an early valve closing event is desired during a normal open cycle of an associated engine valve as just described, control valve 138 is energized via controller 139, causing release of hydraulic fluid from bore 112 which results in controlled collapse of piston 114 as the engine valve rapidly returns to its seat. Prior to the engine valve reaching its seat, the control valve may be re-energized, thus stopping further fluid release and arresting valve train motion. Engine valve seating can be closely controlled by this means in regions where the cam velocity is at or below an acceptable threshold value, typically about 0.2 m/sec at low engine idle speed. If lost-motion functionality is required over a wider range of timing authority including areas of high cam velocity, a valve seating snubber is required, as described further hereinbelow. Energizing of the control valve is managed by a computerized Engine Control Module (ECM) (not shown) in known fashion, with input from a crankshaft encoder and potentially with feedback from an accelerometer on the engine to give an indication of valve seating impact.

If total valve deactivation is desired, such as is the case if cylinder deactivation is desired, control valve 138 is energized for the whole cam lift event so that all motion of the cam and RFF is absorbed by lost-motion displacement of piston 114 within bore 112.

If it is desired to delay opening of an engine valve, control valve 138 may be energized while the RFF is on the base circle portion of the cam. Initial cam motion of the RFF on the cam eccentric portion serves to depress piston 114 in lost motion until such time as valve lift is desired, at which point control valve 138 is de-energized allowing it to close, and the resulting internal hydraulic lock provides a stable fulcrum in a new and lower position for the RFF, resulting in a later opening and lowered, centered lift event.

If, during normal operation there is a tendency for DHLA 100 to "pump up" as is known to happen occasionally for prior art HLAs due to dynamic fluctuations in the valve train, control valve 138 can be energized momentarily to normalize the internal pressure prior to a scheduled valve event, or prior to TDC if there is concern for a possible piston/valve collision.

Figure 5:
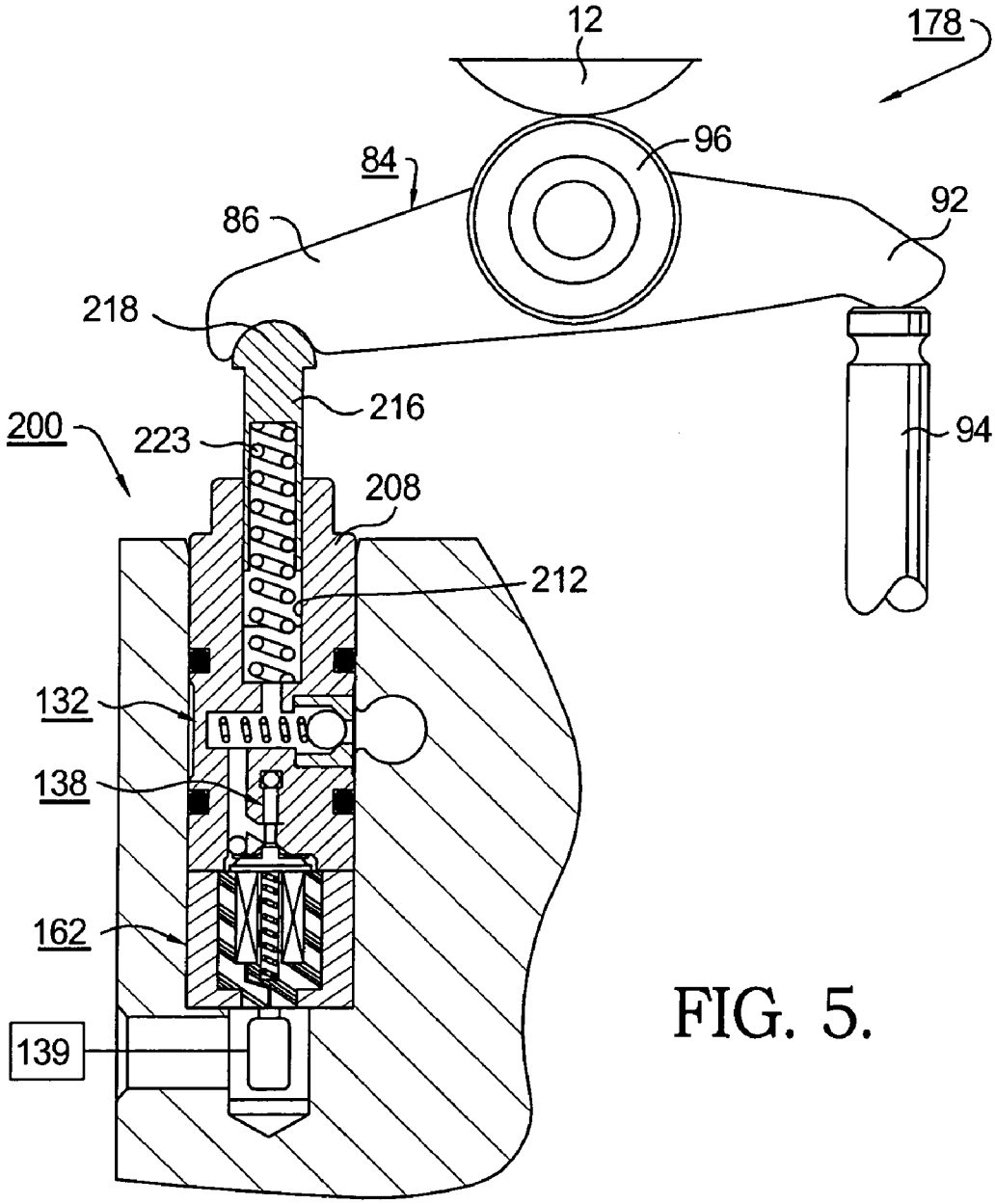
FIG. 5 is an elevational cross-sectional view of the a second embodiment of a DHLA in accordance with the invention.

Referring now to FIG. 5, a second embodiment 200 of a DHLA in accordance with the invention is identical in valving and actuation to first embodiment 100; however, sleeve 216 doubles as the piston (114) and lash spring 223 is disposed within sleeve/piston 216. An advantage of embodiment 200 is that the overall length is shorter than embodiment 100; however, a disadvantage is that the piston is not isolated from side loads imposed by RFF 84 during its normal rotary motion.

Figure 6:
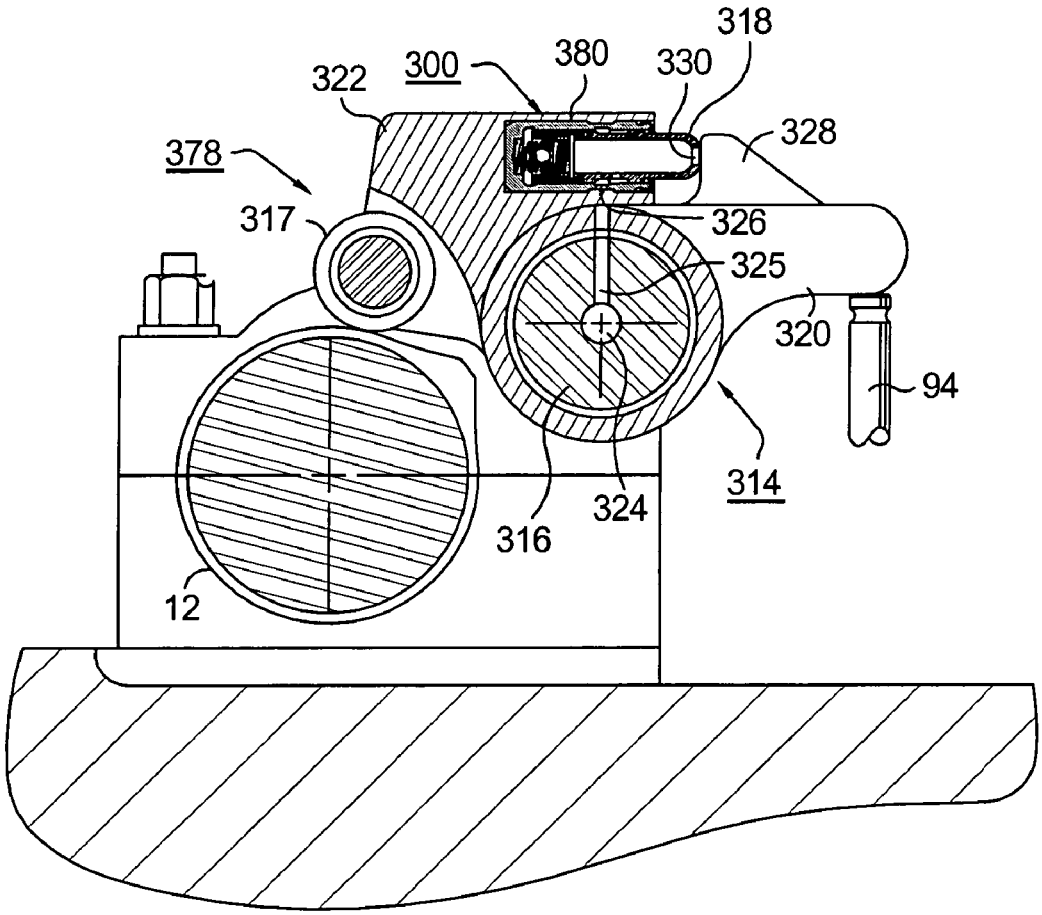
FIG. 6 is an elevational cross-sectional view of a Type 3 valve train employing an articulated rocker arm and conventional hydraulic lash adjuster in accordance with the invention.

Referring now to FIG. 6, a novel Type 3 engine valve train 378 comprises a conventional hydraulic lash adjuster 300 disposed in an articulated rocker arm assembly 314. Rocker arm assembly 314 is rotatably mounted on a rocker arm shaft 316 and includes a roller follower 317 for following the surface of a lobe of camshaft 12, and an actuating arm 320 for actuating valve stem 94.

In the prior art, a comparable Type 3 rocker arm is an inflexible unit wherein rotary motion of the cam is translated faithfully into reciprocal motion of the valve stem. Prior art lash adjustment typically is provided by either a screw head (not shown) on valve stem 94 or a hydraulic valve lifter (HVL) assembly (not shown) disposed between arm 320 and valve stem 94. In HLA embodiment 300, rocker arm assembly 314 is provided as first and second arms 320, 322 independently and rotatably mounted on shaft 316. First arm 320 is adapted to engage valve stem 94.

A well 380 is provided in second arm 322. HLA 300 is disposed in well 380 and is provided with hydraulic fluid, for example, engine oil, via an axial gallery 324 in shaft 316 and a radial passage 325 extending to a connector drilling 326 in arm 322 that communicates with HLA 300. As shown in the exemplary assembly in FIG. 6, HLA 300 is substantially identical in arrangement with HLA 50 shown in FIG. 2, and those components need not be repeated here save to note that the overall size of HLA 300 may be significantly smaller than HLA 50 as needed.

First arm 320 is provided with a buttress 328 having a wear surface 330 for receiving the spherical head 318 of HLA 300. It will be seen that as HLA 300 expands in accordance with the prior art arm 322 is urged away from buttress 328, causing arm 322 and/or arm 320 to counter-rotate on shaft 316, thus changing the angular relationship between the two elements until all mechanical lash in valve train 378 between camshaft 12 and valve stem 94 is eliminated.

Figure 6A:
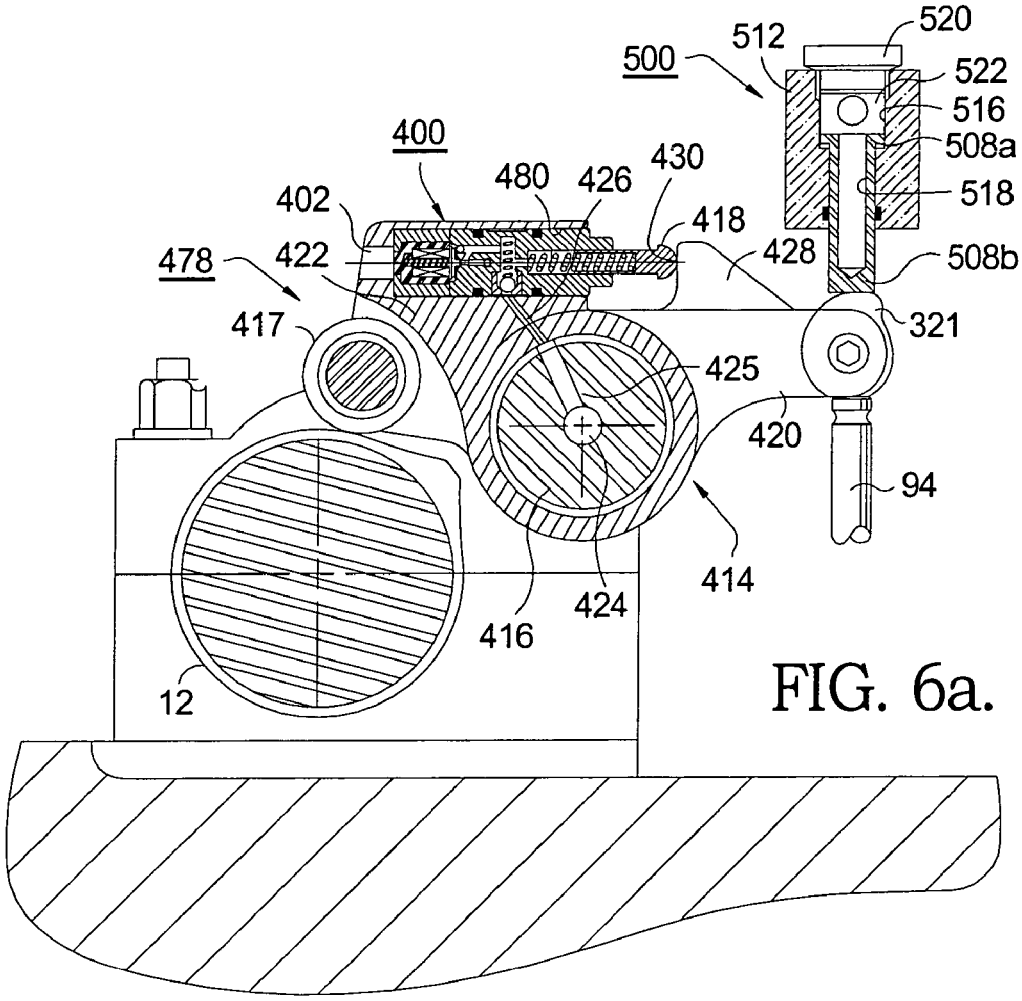
FIG. 6*a* is an elevational cross-sectional view of a Type 3 valve train employing a first embodiment of a Type 3 valve deactivation rocker arm (VDRA) in accordance with the invention, shown in valve-activation mode.

Referring now to FIGS. 6*a* and 7, a third embodiment 400 of a DHLA in accordance with the invention is adapted for use with a Type 3 engine valve train 478. A rocker arm assembly 414 is rotatably mounted on a rocker arm shaft 416 and includes a roller follower 417 for following the surface of a lobe of camshaft 12, and an actuating arm 420 for actuating valve stem 94.

In DHLA embodiment 400, rocker arm assembly 414 is provided as first and second arms 420, 422 independently and rotatably mounted on shaft 416. First arm 420 is adapted to engage valve stem 94 as described further below, and second arm 422 is supportive of cam follower roller 417. A well 480 in second arm 422 is analogous to well 380 in FIG. 6. DHLA 300 is disposed in well 480 and is provided with hydraulic fluid, preferably in the form of diesel fuel oil, via an axial gallery 424 in shaft 416 and a radial passage 425 extending to a connector drilling 426 in arm 422 that communicates with DHLA 400. As shown in the exemplary assembly in FIG. 6*a*, DHLA 400 is substantially identical in arrangement and function with DHLA 200 shown in FIG. 5, and those components need not be repeated here save to note that the overall size of DHLA 400 may be significantly smaller than DHLA 200.

Figure 6B:
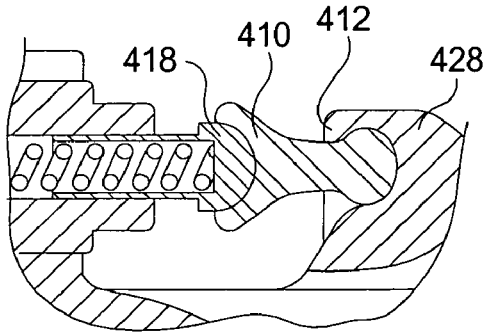
FIG. 6*b* is a cross-sectional view of an embodiment showing a pushrod between the DHLA and buttress of FIG. 6*a;*

First arm 420 is provided with a buttress 428 having a wear surface 430 for receiving the spherical head 418 of DHLA 400. In an alternative embodiment shown in FIG. 6*b*, a short pushrod 410 is interposed between the spherical head 418 of DHLA 400 and a spherical thrust socket 412 located in the buttress 428. Thus, relative motion between the DHLA and buttress, as the rocker arm articulates, is taken up in the thrust socket.

Electrical connection of a pigtail to DHLA 400 may be provided via a tail bore 402 (analogous to bore 102 in FIG. 3). Other forms of electrical connection, for example, via mating slip rings (not shown) on shaft 416 and arm 422, are fully comprehended by the invention.

In operation in valve-activating mode, as DHLA 400 expands like a conventional HLA, arm 422 is urged away from buttress 428, causing arm 422 and/or arm 420 to counter-rotate on shaft 416, thus changing the angular relationship between the two elements until all mechanical lash in valve train 478 between camshaft 12 and valve stem 94 is eliminated. Because rocker arm assembly 478 is thus hydromechanically rigid, rotary action of camshaft 12 is faithfully translated into reciprocal action of valve stem 94.

If in normal operation there is a tendency for DHLA 400 to "pump up" as is known to occur occasionally in prior art HLAs due to dynamic fluctuations in valve train 478, control valve 138 may be energized momentarily to normalize internal pressure prior to a scheduled valve lift event or prior to engine piston TDC if there is concern for a potential piston/valve collision.

Referring now to FIG. 7 in conjunction with FIG. 5, in operation in valve-deactivating lost-motion mode of DHLA 400, control valve 138 is opened by energizing of solenoid assembly 162, permitting hydraulic fluid to be forced from bore 212 thereby allowing collapse of piston 216 into body 208 in lost motion in response to raising of roller follower 417 by camshaft 12. Valve stem 94 is not actuated and the associated engine valve is not opened.

In some applications, it may be desirable to allow the engine valve to open fully in valve-activation mode but to close the valve early by changing assembly 478 to valve-deactivation mode on the closing slope of the valve lift cycle. Energizing of solenoid assembly 162 at this point causes immediate collapse of DHLA 400, resulting in the full closing force of the compressed engine valve spring being brought to bear on the engine valve. Such abrupt closing can cause objectionable valve clatter as well as excessive valve wear and premature failure. Accordingly, a snubber assembly 500 is preferably included in valve train 478 to arrest the motion of valve stem 94 before the valve fully closes and to provide a graduated valve closing.

A problem with typical prior art hydraulic valve seating snubbers is that they have a fixed snubbing characteristic irrespective of operating conditions other than fluid viscosity. In the present case, snubbing is desired over only the final half millimeter or so of engine valve head travel before engagement with the valve seat, and this can be very difficult to arrange for all valves In an engine under all conditions of valve seat wear, recession, and assembly tolerances.

To cater to these variables and to ensure that seating velocity is controlled over only the final portion of travel, a currently preferred embodiment of variably controllable snubber assembly 500 incorporates an eccentric snail cam adjuster 502 at the rocker tip 504 whereby the base circle portion 505 of the snail cam contacts the tip 506 of valve stem 94. The snail cam adjuster is rotated during engine assembly to engage the snubber piston 508 by a desired amount with the engine valve seated. This sets the range of action of the snubber in absorbing travel of the valve stem during the act of valve closing. Snail cam adjuster 502 is formed of a wear-resistant material such as hardened steel and is retained in a slot in rocker tip 504 by a through bolt 510.

Snubber 500 comprises a body 512 having a stepped bore therethrough comprising a first diameter region 516 and a narrower diameter region 518. A stepped snubber piston comprises a large-diameter portion 508*a* and a small diameter portion 508*b* and is slidably disposed in bores 516/518. Bore 516 is closed as by a screw plug 520, forming a closed chamber 522 above piston 508*a*. Bore region 516 is hydraulically pressurized dynamically to a predetermined pressure, preferably by connection to the same source of hydraulic fluid supplying fluid to gallery 424 for DHLA 400. The pressure within the snubber assembly may be controllably varied in known fashion as a function of engine speed or other desired parameter to controllably modulate the valve seating velocity.

Figure 8:
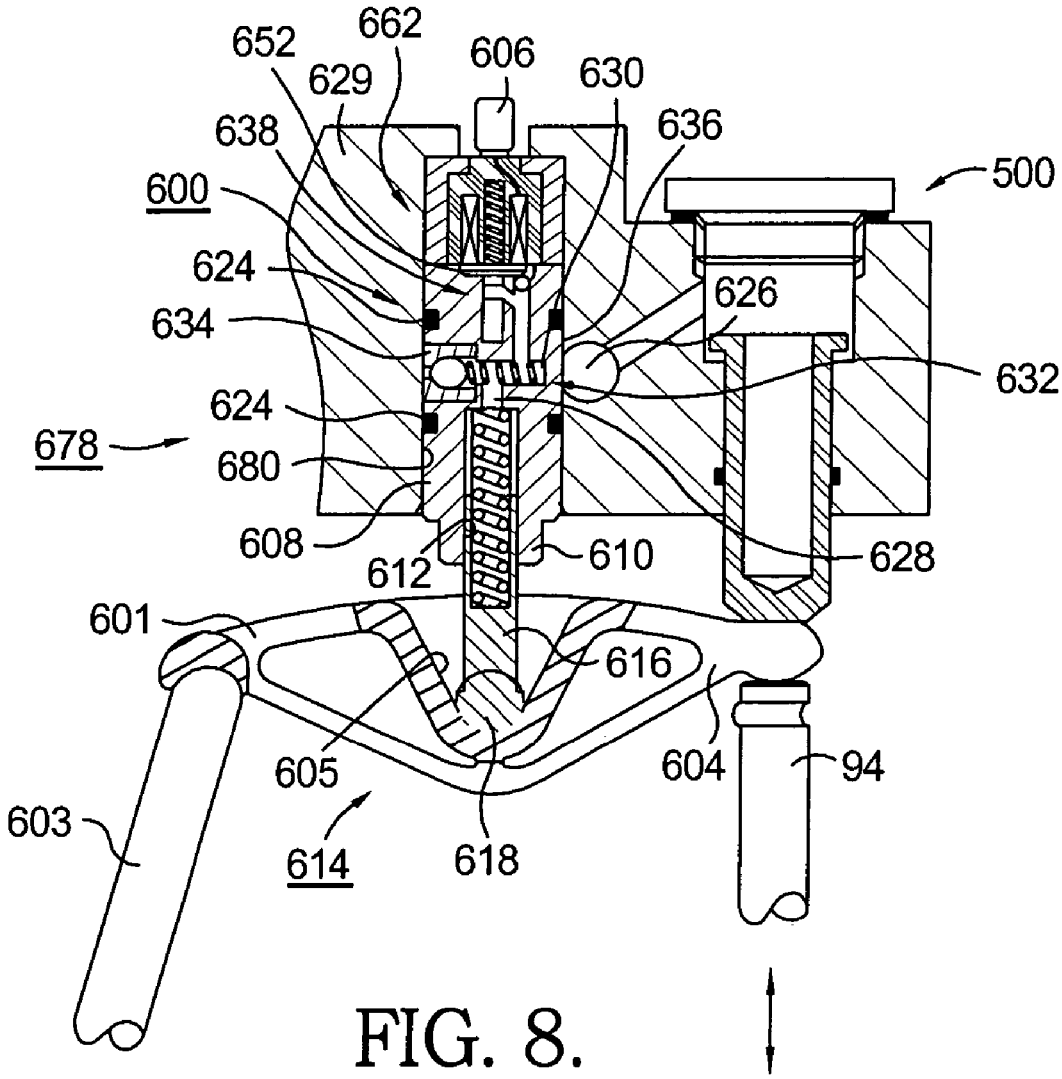
FIG. 8 is an elevational cross-sectional view of an alternate version of a Type 3 valve train employing a VDRA, in accordance with the invention, shown in valve-activation mode.

Referring now to FIG. 8, a fourth embodiment 600 of a DHLA in accordance with the invention is adapted for use with the alternate version of a Type 3 engine valve train 678 described above. A rocker arm assembly 614 is pivotably positioned, at its midpoint, against spherical end 618 of DHLA 600 and includes a first arm 601 for receiving an end of pushrod 603, a second arm 604 for engaging and actuating valve stem 94 and valley 605 for receiving end 618 of DHLA as described further below.

DHLA 600 is disposed in well 680 formed in head 629. Well 680 is open ended at its distal end to accommodate an electrical connector (not shown) for spade lug 606.

Body 608 of DHLA 600 is close-fitting into well 680 and includes a snout 610 having a bore 612 at its outer end into which a close-fitting piston 616 is slidably disposed. Piston 616 includes spherical end 618 which engages valley 605 as described above. Piston 616 has a length sufficient to accommodate both valve lost-motion travel and lash adjustment travel.

Body 608 is preferably sealed into well 680 by first and second O-rings 624 disposed on either side of a hydraulic fluid gallery 626 formed in head 629 for supplying hydraulic fluid, preferably diesel fuel, to DHLA 600. Within body 608 and communicating with bore 612 via first and second drillings 628, 630 is a spring-loaded inlet check valve 632 which may be of the ball or flute-guided conical seat type. Preferably, valve seat 634 is pressed into place to retain the valve components. A shallow annular groove 636 permits access of hydraulic fluid from gallery 626 to check valve 632 at any installed rotational orientation of DHLA 600.

The details of lost-motion control valve 638, armature 652 and solenoid stator assembly 662 are identical to valve, armature and stator assembly 138, 152 and 162, as described in the first embodiment, and need not be described again.

In operation, in valve-activating mode, as DHLA 600 expands like a conventional HLA to provide a pivot point on which rocker arm assembly 614 pivots to cause the engine valve to open, all mechanical lash in valve train 678 between camshaft pushrod 603 and valve stem 94 is eliminated. In operation in valve-deactivating lost-motion mode of DHLA 600, control valve 638 is opened by energizing of solenoid assembly 662, allowing collapse of piston 616 into body 608 in lost motion in response to raising of pushrod 604 by the camshaft. Valve stem 94 is not actuated and the associated engine valve is not opened.

Snubber assembly 500 may be similarly provided, as described above with respect to the third embodiment, to arrest the motion of valve stem 94 before the valve fully closes and to provide a graduated valve closing.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An electro-hydraulic lash adjuster for selectively activating and deactivating a valve train in an internal combustion engine, comprising:

a) a body having a longitudinal bore;

b) a piston slidably disposed in said longitudinal bore;

c) a check valve disposed in said body in communication with said longitudinal bore for admitting hydraulic fluid from said engine to said longitudinal bore to displace said piston outwards of said body;

d) an adjuster valve disposed within said body in communication with said longitudinal bore to selectively capture and release hydraulic fluid in said longitudinal bore; and e) a solenoid actuator connected to said adjuster valve for selectively opening and closing said adjuster valve to alternatively open and close said longitudinal bore in alternatively deactivating and activating said valve train;

wherein hydraulic fluid selectively captured within said longitudinal bore by said adjuster valve prevents said piston from collapsing within said longitudinal bore, and wherein hydraulic fluid selectively released from within said longitudinal bore by said adjuster valve permits said piston to collapse within said longitudinal bore.

2. A lash adjuster in accordance with claim 1 wherein said hydraulic fluid is diesel fuel.

3. A lash adjuster in accordance with claim 1 wherein fluid-conducting passages in said body are configured such that substantially equal and therefore balancing hydraulic pressures are brought to bear on said adjuster valve in the opening and closing directions.

4. A lash adjuster in accordance with claim 1 wherein said adjuster valve is closed when said solenoid actuator is de-energized.

5. A lash adjuster in accordance with claim 1 wherein said piston includes an end for engaging an element of said valve train.

6. A lash adjuster in accordance with claim 1 further comprising a sleeve slidably disposed on an extension of said body and containing said piston.

7. A lash adjuster in accordance with claim 6 wherein said sleeve includes an end for engaging an element of said valve train.

8. A lash adjuster in accordance with claim 1 further comprising a lash spring for urging said piston outwards of said body.

9. A lash adjuster in accordance with claim 1 wherein said internal combustion engine is compression-ignited.

10. A system for selectively activating and deactivating a valve train in an internal combustion engine, comprising:

a) an electro-hydraulic lash adjuster connected to said engine, said hydraulic lash adjuster being in fluid communication with hydraulic fluid supplied by said engine and being in electrical connection with a controller, said electro-hydraulic lash adjuster comprising a body having a longitudinal bore, a piston slidably disposed in said longitudinal bore, a check valve disposed in said body in communication with said longitudinal bore for admitting hydraulic fluid from said engine to said longitudinal bore to displace said piston outwards of said body, an adjuster valve disposed within said body in communication with said longitudinal bore to selectively capture and release hydraulic fluid in said longitudinal bore, and a solenoid actuator connected to said adjuster valve for selectively opening and closing said adjuster valve to alternatively open and close said longitudinal bore in alternatively deactivating and activating said engine valve train; and b) a roller finger follower engaged with said electro-hydraulic lash adjuster;

wherein hydraulic fluid selectively captured within said longitudinal bore by said adjuster valve prevents said piston from collapsing within said longitudinal bore, and wherein hydraulic fluid selectively released from within said longitudinal bore by said adjuster valve permits said piston to collapse within said longitudinal bore.

11. A system in accordance with claim 10 wherein said lash adjuster is disposed in a well formed in a head of said engine.

* * * * *